US005611308A

United States Patent [19]

Hackett

[11] Patent Number: 5,611,308

[45] Date of Patent: Mar. 18, 1997

[54] APPARATUS FOR INTERCONNECTING AN ACTUATOR AND AN EXHAUST VALVE OPENING MEMBER

[75] Inventor: David E. Hackett, Washington, Ill.

[73] Assignee: Caterpillar Inc., Peoria, Ill.

[21] Appl. No.: 595,968

[22] Filed: Feb. 6, 1996

[51] Int. Cl.[6] ..... F02D 13/04

[52] U.S. Cl. ..... 123/321; 123/90.47

[58] Field of Search ..... 123/90.39, 90.47, 123/321, 322; 74/559

[56] References Cited

U.S. PATENT DOCUMENTS

| | | | |
|---|---|---|---|
| 1,583,335 | 5/1926 | Borschel | 123/90.47 X |
| 3,220,392 | 11/1965 | Cummins | 123/321 |
| 3,786,792 | 1/1974 | Pelizzoni et al. | 123/321 |
| 4,192,263 | 3/1980 | Kitagawa et al. | 123/90.39 |
| 4,793,307 | 12/1988 | Quenneville et al. | 123/323 |
| 4,864,983 | 9/1989 | Breitbarth | 123/90.61 |
| 5,165,375 | 11/1992 | Hu | 123/321 |
| 5,195,489 | 3/1993 | Reich | 123/321 |
| 5,365,916 | 11/1994 | Freiburg et al. | 123/320 |

FOREIGN PATENT DOCUMENTS

| | | | |
|---|---|---|---|
| 3-50304 | 3/1991 | Japan | 123/90.39 |

*Primary Examiner*—Tony M. Argenbright
*Attorney, Agent, or Firm*—Marshall, O'Toole, Gerstein, Murray & Borun

[57] ABSTRACT

Apparatus for interconnecting an actuator and a pivotable exhaust valve opening member includes a recess in the exhaust valve opening member and a bearing member disposed in the recess and capable of swiveling therein. A plunger is carried by the actuator and is movable into contact with an engagement surface of the bearing member.

13 Claims, 2 Drawing Sheets

APPARATUS FOR INTERCONNECTING AN ACTUATOR AND AN EXHAUST VALVE OPENING MEMBER

TECHNICAL FIELD

The present invention relates generally to interconnection devices, and more particularly to an apparatus for interconnecting a motive power device, such as an actuator, and a member for opening an exhaust valve of an internal combustion engine.

BACKGROUND ART

Engine braking or retarder systems are often used to assist and supplement wheel brakes to slow heavy vehicles, such as tractor-trailers. Engine braking systems convert the vehicle engine into a power consuming air compressor by opening one or more of the engine exhaust valves during compression strokes of the engine. In order to accomplish this result, one or more actuators are provided to contact and move either the exhaust valves directly or valve opening apparatus, such as a crosshead or rocker arm, coupled to the exhaust valves.

Freiburg et al. U.S. Pat. No. 5,365,916 discloses an engine braking system wherein a slave piston is disposed adjacent a pivoting engine exhaust valve rocker arm. The slave piston includes a foot adapted to engage a flat surface which is machined on the rocker arm. The foot is capable of swiveling to accommodate the changing orientation of the flat surface as the slave piston extends and pivots the rocker arm.

While the Freiburg et al. device may be effective to open exhaust valves at desired times to accomplish engine braking, the use of a machined surface on the rocker arm results in the need for an undercut or relief in a portion of the rocker arm so that sufficient clearance is provided for the machining apparatus. This portion of the rocker arm is subjected to high forces during engine operation resulting in stress concentrations that can cause reliability problems. Also, the engine brake system is relatively tall, thereby limiting the potential applications for the braking system.

DISCLOSURE OF THE INVENTION

An apparatus for interconnecting an actuator and an exhaust valve eliminates the undesirable stress concentrations noted above and permits an engine braking system with which the apparatus is used to be reduced in height.

More particularly, according to one aspect of the present invention, an apparatus for interconnecting an actuator and a pivotable exhaust valve opening member includes a recess in the exhaust valve opening member and a bearing member disposed in the recess and capable of swiveling therein. The bearing member includes an engagement surface and a plunger is carried by the actuator and is movable into contact with the engagement surface.

Preferably, the recess includes substantially spherical walls and may further include a groove for receiving a retainer therein. Also preferably, the bearing member includes a groove and the retainer comprises an O-ring disposed in the grooves of the recess and the member. Still further in accordance with the preferred embodiment, the bearing member further includes a nose portion having a rounded surface in engagement with the substantially spherical walls of the recess.

The bearing member may further include a flat surface at an end of the nose portion and still further may include an oil passage therethrough extending from the engagement surface to the flat surface.

According to a further aspect of the present invention, apparatus for interconnecting an actuator and a pivotable rocker arm wherein the rocker arm is in contact with an exhaust valve includes a recess in the rocker arm and a member disposed in the recess and capable of swiveling therein and including a substantially flat engagement surface. A retaining ring is disposed between the recess and the member and a plunger is carried by the actuator and includes a substantially flat bearing surface movable into contact with the engagement surface.

Other features and advantages are inherent in the apparatus claimed and disclosed or will become apparent to those skilled in the art from the following detailed description in conjunction with the accompanying drawings.

BEST MODE FOR CARRYING OUT THE INVENTION

Figure 1:
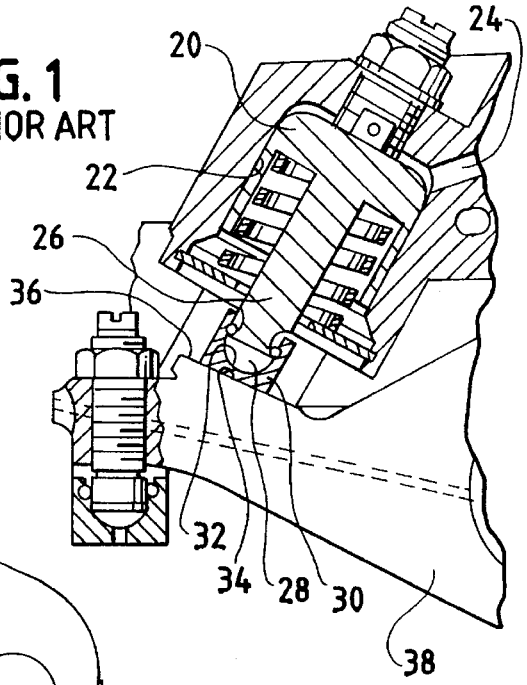
FIG. 1 PRIOR ART
FIG. 1 comprises a partial sectional view of a slave piston of a prior art engine braking system together with a portion of an engine rocker arm.

Referring now to FIG. 1, a prior art engine braking system includes a slave piston 20 disposed within a bore 22 which is in fluid communication with a passage 24. The slave piston 20 further includes a downwardly extending plunger 26 having a substantially spherical ball-shaped end 28. A swivel foot 30 includes a substantially ball-shaped recess 32 therein which accepts the ball-shaped end 28 of the extension 26. The swivel foot 30 is capable of swiveling about the ball-shaped end 28 as noted in greater detail hereinafter.

Figure 2:
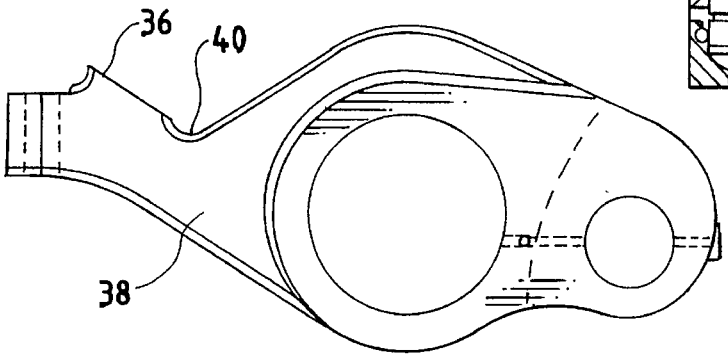
FIG. 2 PRIOR ART
FIG. 2 comprises a side elevational view of the rocker arm of FIG. 1.

The swivel foot 30 further includes a flat end surface 34 which engages a flat machined surface 36 of a rocker arm 38. Referring also to FIG. 2, the rocker arm is pivotable about an axis to engage an exhaust valve cross head or bridge (not shown) which in turn bears against two or more exhaust valves (also not shown) associated with a combustion chamber of an engine.

When pressurized fluid is admitted through the passage 24 into the bore 22, the slave piston 20 moves downwardly, causing the extension 26 and the swivel foot 30 to take up a lash and move into contact with the flat surface 36 of the rocker arm 38. The slave piston 20 thereafter continues to move downwardly, thereby pivoting the rocker arm 38 and opening the exhaust valves contacted thereby. During such pivoting, the swivel foot 30 swivels about the ball-shaped end 28 of the extension 26 to maintain substantially full contact between the flat surface 34 of the swivel foot 30 and the flat surface 36 of the rocker arm 38.

As seen specifically in FIG. 2, the need to utilize a machined flat surface 36 on the rocker arm 38 results in the further requirement for an undercut or relief in a portion 40 of the rocker arm 38 so that sufficient space is provided to allow the machining apparatus to form the surface 36. Because the portion 40 is subjected to substantial forces during normal operation of the engine, stress concentrations arise therein and create reliability problems, such as fracturing of the rocker arm.

Figure 3:
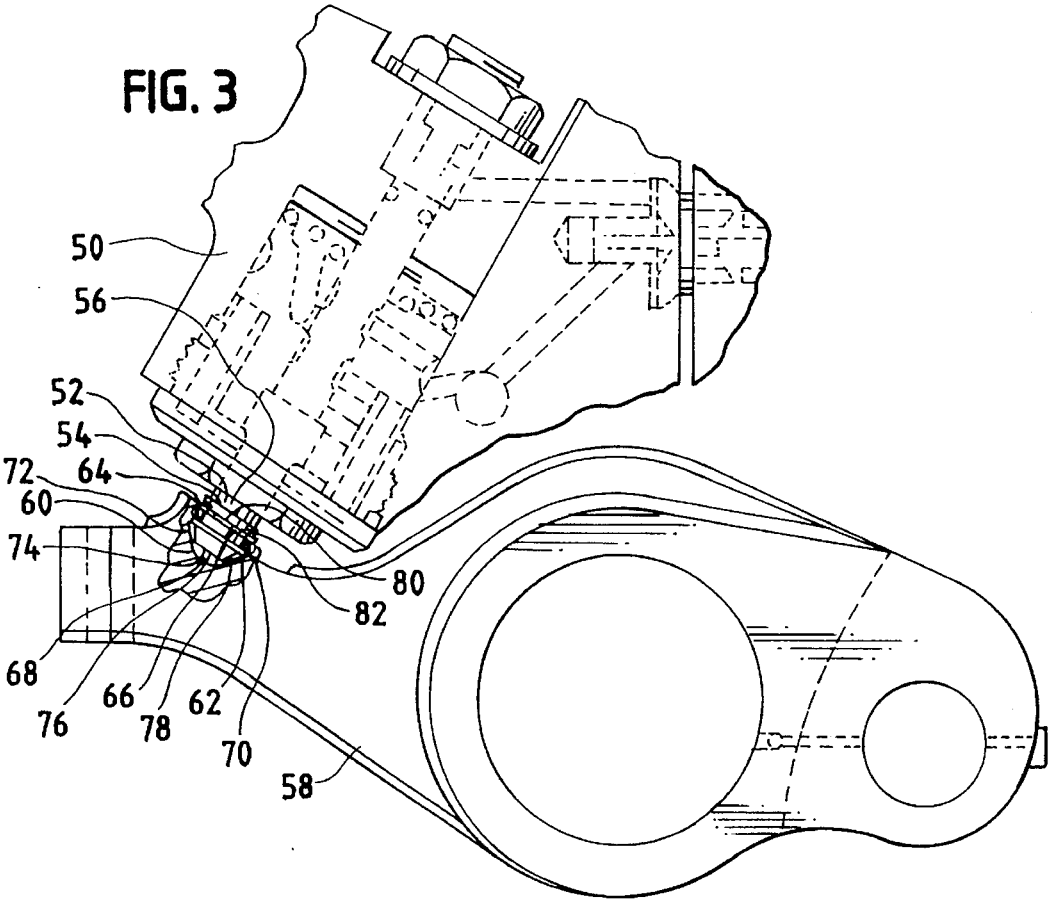
FIG. 3 comprises a side elevational view of the interconnection apparatus of the present invention.
Figure 4:
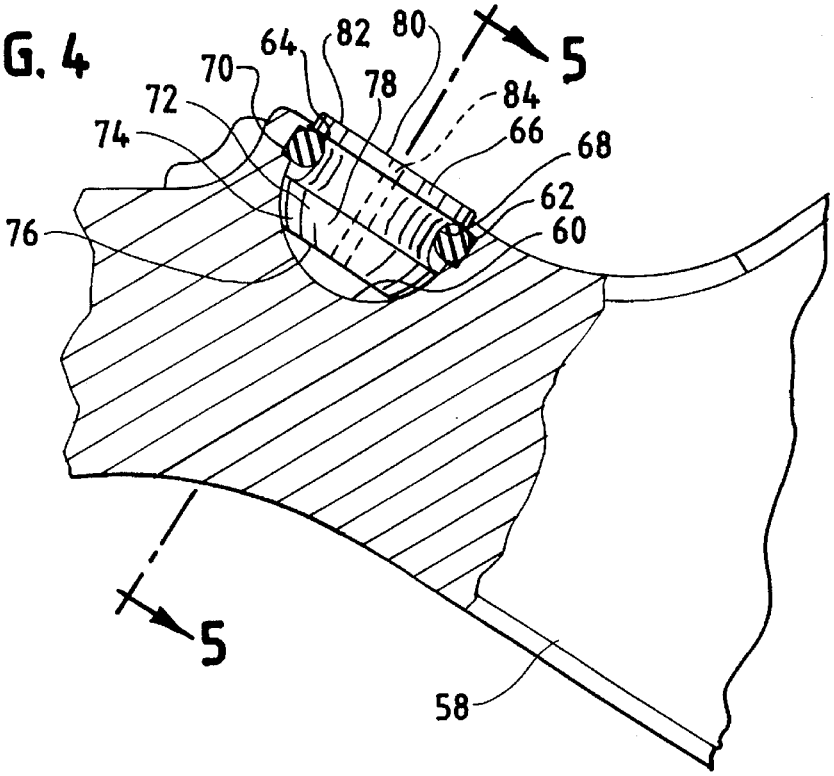
FIG. 4 comprises an enlarged partial sectional view of a portion of the apparatus of FIG. 3.
Figure 5:
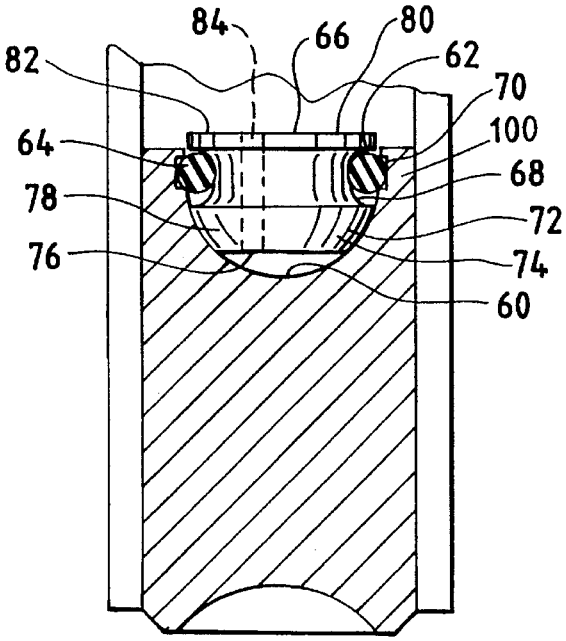
FIG. 5 comprises a sectional view taken generally along the lines 5—5 of FIG. 4.

FIGS. 3–7 illustrate the apparatus of the present invention. Referring first to FIGS. 3–5, an actuator 50 of a braking system includes a plunger 52 having a substantially flat bearing surface 54 at an end 56 thereof.

Figure 6:
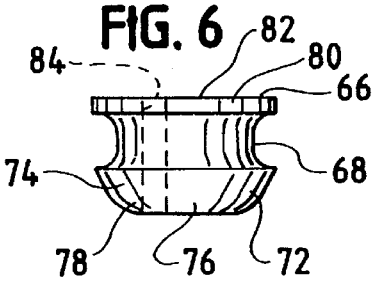
FIG. 6 comprises a side elevational view of the bearing member of FIGS. 4 and 5.
Figure 7:
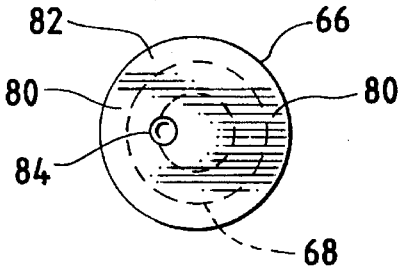
FIG. 7 comprises a plan view of the bearing member of FIGS. 4–6.

A rocker arm 58 includes a recess 60 formed therein which, as seen specifically in FIG. 5, is preferably spherical in cross-section. The recess 60 includes a circumferential groove 62 at an end 64 thereof. Referring also to FIGS. 6 and 7, a bearing member 66 is disposed in the recess 60 such that a groove 68 of the bearing member is disposed opposite the circumferential groove 62 of the recess 60. A elastomeric O-ring 70 is disposed in the space between the aligned grooves 62,68. As noted in greater detail hereinafter, the O-ring 70 permits the bearing member 66 to swivel within the recess 60 to a limited angular extent while still preventing escape of the bearing member 66 from the recess 60.

The bearing member 66 further includes a nose portion 72 having a rounded surface 74 extending from the groove 68 to a substantially flat surface 76 at an end 78 of the bearing member 66. A substantially flat engagement or bearing surface 80 is disposed at end 82 of the bearing member 66 opposite the end 78. An oil passage 84 extends through the bearing member 66 from the flat surface 76 to the engagement surface 80.

Industrial Applicability

During operation of the braking system, a small lash or space is typically provided between the flat bearing surface 54 and the engagement surface 80 of the bearing member 66. When engine braking is to be effected, the actuator 50 is operated to extend the plunger 52 so that the flat bearing surface 54 contacts the engagement surface 80. Thereafter, continued extension of the plunger 52 occurs, thereby causing the rocker arm 58 to pivot and open the associated exhaust valves. During such movement, the bearing member 66 swivels or rotates within the recess 60, such movement being guided by contact of the rounded surface 74 with the substantially spherical walls defining the recess 60. Wear at such surfaces is minimized by the introduction of oil residing within the head of the engine through the passage 84 to the space between the substantially flat surface 76 and the walls defining the recess 60 In this regard, it should be noted that the surface 76 need not be flat, but simply must be of a shape which allows oil flow from the passage 84 to the interface between the surface 74 and the walls defining the recess 60.

Thus, as noted above, the bearing member 66 swivels during pivoting of the rocker arm 58 to maintain full engagement of the substantially flat bearing surface 54 and the engagement surface 80. It should be noted that the surfaces 54 and 80 need not be flat; rather, all that is required is that the surfaces mate in some fashion to ensure positive driving of the rocker arm 58 by the plunger 52 and to accommodate the linear motion of the plunger 52 and the angular motion of the rocker arm 28.

When the braking system commands closing of the exhaust valves, the plunger 52 is retracted, causing the rocker arm 58 to pivot back to the position shown in FIGS. 3 and 4. Thereafter, the plunger 52 further retracts to re-establish the lash between the surface 54 and the engagement surface 80. As before, the bearing member 66 swivels within the recess 60 to maintain solid contact between the bearing surface 54 and the engagement surface 80. Once the lash is re-established by separating the surface 54 from the surface 80, the bearing member 66 is maintained in a centered or neutral position and the bearing member 66 is maintained within recess 60 by the resilient O-ring 70.

The present invention does not require that a flat be machined on the rocker arm, and hence there is no need to provide a relief or undercut in the rocker arm as compared with the prior art device shown in FIGS. 1 and 2. Accordingly, stress concentration in this portion of the rocker arm is reduced and reliability is improved. Further, as compared with the Freiburg et al. device, the present invention includes an upwardly extending circumferential sleeve 100 surrounding the bearing member 66 which adds to the strength of the rocker arm 58 at such location. In addition, because the swivel foot of the prior art apparatus shown in FIGS. 1 and 2 is eliminated, the overall height of the engine braking system can be reduced, thereby leading to an increase in the number of installations in which the engine brake can be used.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. Apparatus for interconnecting an actuator and a pivotable exhaust valve opening member, comprising:

a recess in the exhaust valve opening member;

a bearing member disposed in the recess and capable of swiveling therein and including an engagement surface; and a plunger carried by the actuator and movable into contact with the engagement surface.

2. The apparatus of claim 1, wherein the recess includes substantially spherical walls.

3. The apparatus of claim 2, wherein the recess further includes a groove for receiving a retainer therein.

4. The apparatus of claim 3, wherein the bearing member includes a groove and the retainer comprises an O-ring disposed in the grooves of the recess and the member.

5. The apparatus of claim 2, wherein the bearing member further includes a nose portion having a rounded surface in engagement with the substantially spherical walls of the recess.

6. The apparatus of claim 5, wherein the bearing member further includes a flat surface at an end of the nose portion.

7. The apparatus of claim 6, wherein the bearing member further includes an oil passage therethrough extending from the engagement surface to the flat surface.

8. Apparatus for interconnecting an actuator and a pivotable rocker arm wherein the rocker arm is in contact with an exhaust valve, comprising:

a recess in the rocker arm;

a member disposed in the recess and capable of swiveling therein and including a substantially flat engagement surface;

a retaining ring disposed between the recess and the member; and a plunger carried by the actuator and having a substantially flat bearing surface movable into contact with the engagement surface.

9. The apparatus of claim 8, wherein the recess includes substantially spherical walls.

10. The apparatus of claim 9, wherein each of the recess and the member includes a groove and the retainer comprises an O-ring disposed in the grooves of the recess and the member.

11. The apparatus of claim 10, wherein the member further includes a nose portion having a rounded surface in engagement with the substantially spherical walls of the recess.

12. The apparatus of claim 11, wherein the member further includes a flat surface at an end of the nose portion.

13. The apparatus of claim 12, wherein the member further includes an oil passage therethrough extending from the engagement surface to the flat surface.

* * * * *